United States Patent [19]

Belcher et al.

[11] Patent Number: 4,966,231

[45] Date of Patent: Oct. 30, 1990

[54] HEAT EXCHANGER CONSTRUCTION

[75] Inventors: Bryan L. Belcher, Leamington Spa; Michael P. Daniels, Derby, both of England

[73] Assignee: Rolls-Royce plc, London, England

[21] Appl. No.: 480,923

[22] Filed: Feb. 16, 1990

[30] Foreign Application Priority Data

Mar. 15, 1989 [GB] United Kingdom ..... 8905979

[51] Int. Cl.[5] ..... F28F 3/06

[52] U.S. Cl. ..... 165/166; 165/167; 165/157

[58] Field of Search ..... 165/157, 166, 167, 916

[56] References Cited

U.S. PATENT DOCUMENTS

| | | | |
|---|---|---|---|
| 2,617,634 | 11/1952 | Jendrassik | 165/167 X |
| 2,959,401 | 11/1960 | Burton | 165/166 |
| 3,661,203 | 5/1972 | Mesher | 165/167 |
| 4,246,963 | 1/1981 | Anderson | 165/166 |
| 4,270,602 | 6/1981 | Foster | 165/167 |

FOREIGN PATENT DOCUMENTS

| | | | |
|---|---|---|---|
| 2322730 | 11/1974 | Fed. Rep. of Germany | 165/916 |
| 62-242791 | 10/1987 | Japan | 165/166 |
| 500294 | 6/1939 | United Kingdom . | |
| 929893 | 6/1963 | United Kingdom . | |

*Primary Examiner*—Martin P. Schwadron
*Assistant Examiner*—Allen J. Flanigan
*Attorney, Agent, or Firm*—Cushman, Darby & Cushman

[57] ABSTRACT

A heat exchanger comprises a casing through which a first heat exchange fluid flows and within which is mounted a heat exchange matrix. The matrix comprises a stack of primary plates which are maintained in spaced apart relationship by corrugated sheets so that alternate flow paths for the first heat exchange fluid and a second heat exchange fluid are respectively defined. Alternate pairs of adjacent plates are interconnected by flexible enclosing members to define the flow paths for the second heat exchange fluid.

4 Claims, 2 Drawing Sheets

HEAT EXCHANGER CONSTRUCTION

This invention relates to heat exchangers and has particular reference to the construction of plate/fin type heat exchangers.

Plate/fin type heat exchangers typically comprise a stack of alternate layers of primary plates and corrugated sheet material which define passages for the flow of fluids which it is desired to place in heat exchange relationship. Commonly the edges of the primary material are attached to each other at their peripheries by U-shaped cross-section bridging pieces. The bridging pieces serve the dual role of providing the heat exchanger with structural rigidity and preventing fluid leakage from the heat exchanger.

It has been found that such bridging pieces can be put under considerable strain during heat exchanger operation, particularly when the heat exchanger is subject to transient conditions i.e. when one of the heat exchanger fluids undergoes a rapid change in temperature. This can commonly occur in heat exchangers which are used in conjunction with gas turbine engines when, for instance, one of the heat exchanger fluids is the exhaust efflux of the engine. When the engine starts up, there is an extremely rapid rise in temperature of the engine's exhaust efflux. Such rapid changes in temperature put considerable strain on the bridging pieces and it is quite common for the bridging pieces to crack as a result of fatigue.

It is an object of the present invention to provide a heat exchanger in which such problems are substantially avoided.

According to the present invention, a heat exchanger comprises a matrix comprising a stack of primary plates, each of said plates being held in spaced apart relationship from adjacent plates by flexible spacer means so that alternate flow paths for first and second heat exchange fluids respectively are defined by said plates, the peripheries of at least alternate pairs of adjacent plates being interconnected by flexible enclosing members so that the flow paths for the first of said heat exchange fluids are not in flow communication with the flow paths for the second of said heat exchange fluids, fluid delivery and exhaust means being respectively provided for each of said first and second fluids to direct said fluids into their respective flow paths within said matrix and exhaust said fluids from those flow paths.

The invention will now be described, by way of example, with reference to the accompanying drawings in which.

Figure 1:
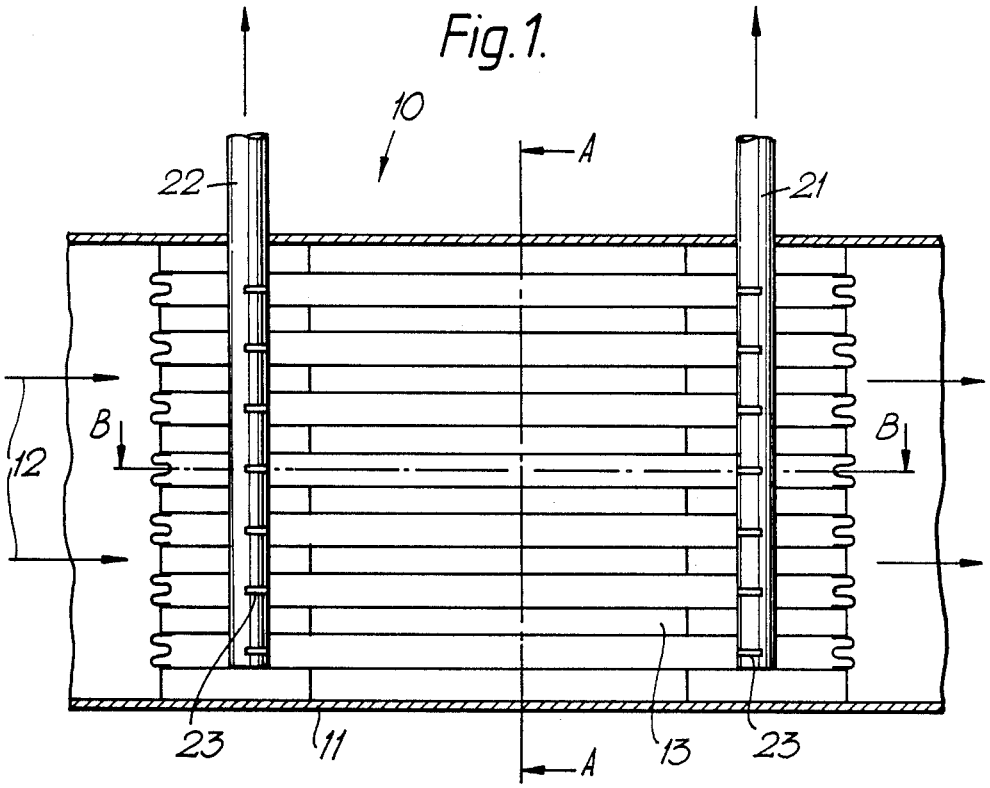
FIG. 1 is a sectioned side view of a heat exchanger in accordance with the present invention.
Figure 2:
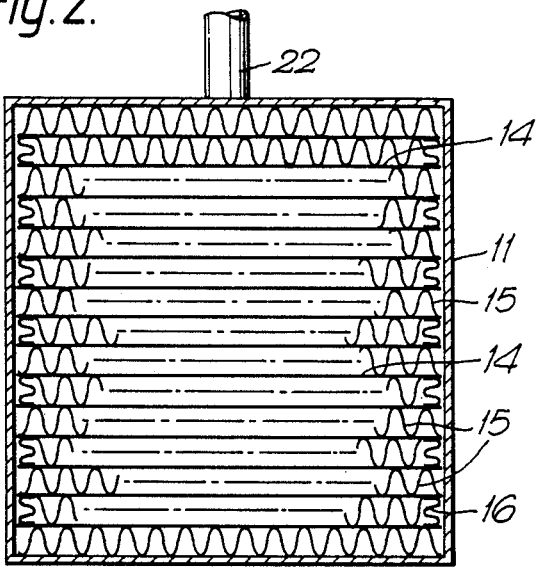
FIG. 2 is a view on section line A—A of FIG. 1.

With reference to FIG. 1, a heat exchanger generally indicated at 10 comprises a casing 11 through which a flow of hot gas, for instance the exhaust efflux of a gas turbine engine, flows in the direction indicated by the arrows 12. The casing 11 encloses a heat exchanger matrix 13, the internal structure of which can be seen more clearly if reference is now made to FIG. 2.

Essentially the heat exchanger matrix 13 comprises a stack of primary plates 14 of a suitable alloy which are held in equally spaced apart relationship by corrugated sheets 15 of a further suitable alloy. Those portions of the corrugated sheets 15 which contact the primary plates 14, that is the peaks of the corrugations, are brazed thereto. However neither the primary plates 14 nor the corrugated sheets 15 are attached to the internal surface of the casing 11. The corrugated sheets 15, in addition to maintaining the primary plates 14 in spaced apart relationship, provide an interconnection between the primary plates 14 which has a certain degree of flexibility so that in turn a certain degree of relative movement between the primary plates 14 is possible.

Figure 4:
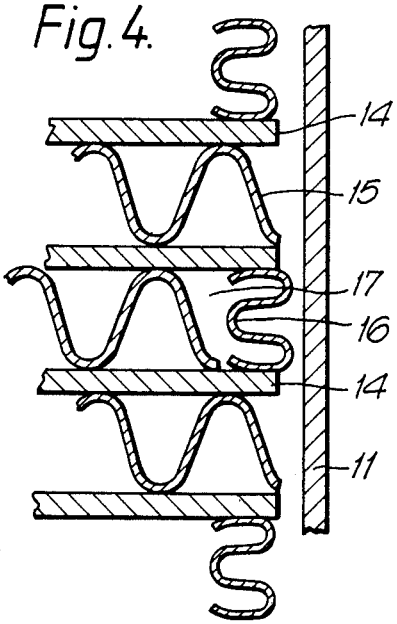
FIG. 4 is a sectioned view on an enlarged scale of a portion of the heat exchanger shown in FIGS. 1–3.

The peripheries of alternate pairs of primary plates 14 are interconnected by flexible enclosing members 16 which can be seen more clearly if reference is now made to FIG. 4. The enclosing members 16 are also in the form of corrugated sheets. However the corrugations extend in a direction which is normal to that in which the corrugations in the sheets 15 extend. The enclosing members 16 are formed from a suitable alloy and are brazed to the primary plates 14 which they engage. The enclosing members 16 are not attached to the internal surface of the casing 11.

Although the enclosing members 16 are shown as being of corrugated form, it will be appreciated that other flexible forms could be used if so desired.

It will be seen therefore that the alternate pairs of primary plates 14 which are interconnected by the enclosing members 16 define discreet enclosed chambers 17 which are not in communication with the spaces defined by the remaining pairs of primary plates 14 nor with the remainder of the interior of the heat exchanger casing 11.

Figure 3:
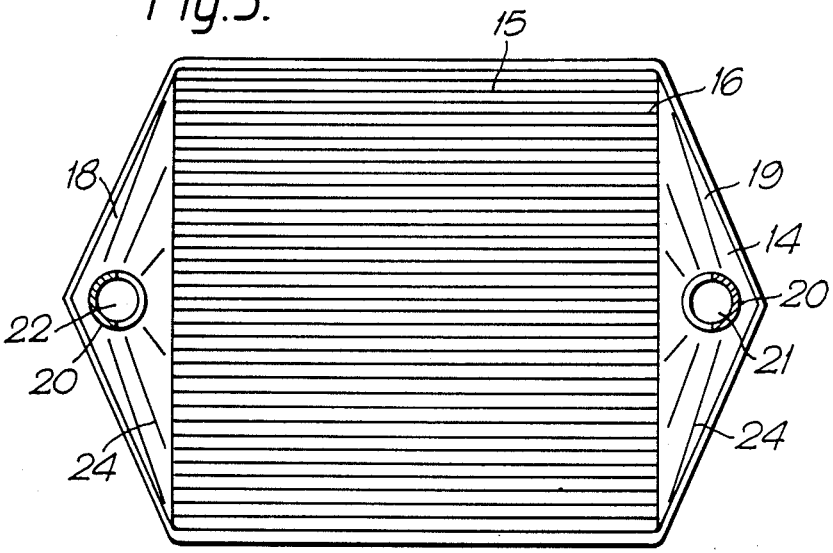
FIG. 3 is a view on section line B—B of FIG. 1.

Each of the primary plates 14 is of hexagonal plan form as can be seen in FIG. 3 so that at each of its upstream and downstream ends (with respect to the gas flow 12), triangular shaped areas 18 and 19 are defined which are not interconnected by the corrugated sheets 15. The areas 18 and 19 are each provided with an aperture 20 and the apertures 20 are aligned so as to receive inlet and outlet tubes 21 and 22 respectively in sealing engagement. The inlet tube 21, which carries a flow of a cool gas, for instance air, is located in the downstream areas 19 whereas the outlet tube 22 is located in the upstream areas 18.

Each of the tubes 21 and 22 is provided with slits 23 which provide communication between the tube 21 and 22 interiors and the enclosed chambers 17. Thus the cool air which flows through the inlet tube 21 passes in turn through the slits 23 and into the enclosed chambers 17. Guide vanes 24 in the areas 19 ensure that the air exhausted through the slots 24 is directed through all of the passages defined by the corrugated sheets 15 in the chambers 17 to further guide vanes 24 provided in the areas 18. The air is then directed by the guide vanes 24 to flow through the slits 23 in the outlet tube 22 whereupon it passes through the outlet tube 22 and out of the heat exchanger 10.

It will be seen therefore that the hot gas flow 12 flows between the primary plate 14 pairs which are not interconnected by the enclosing members 16 whereas the cool air flow passing through the inlet pipe 21 flows through the chambers 17 in the opposite direction to that of the hot gas flow 12. Since the two gas flows are separated only by the primary plates 14, they are placed in contra-flow heat exchange relationship. It will be appreciated however than in certain circumstances it may be acceptable for the two gas flows to be in parallel flow relationship i.e. both flowing in the same direction. The corrugated sheets 15 are in physical contact with both the primary plates 14 and with the gas flows, thereby assisting in the heat exchange process.

It will be seen therefore that in operation, the whole of the heat exchanger matrix 13 is bathed in the hot gas stream 12 passing through the casing 11. No special precautions need to be taken therefore to ensure that all of the hot gas stream 12 passes through the matrix. In the event of sudden changes in the temperature of the gas stream 12, the heat exchanger matrix 13 is free to expand and contract within the casing 11, thereby avoiding stressing of that casing 11. Moreover, the flexible form of construction of the heat exchanger matrix 13 resulting from the use of the flexible enclosing members 16 ensures that any such sudden changes in temperature do not result in excessive stressing of the matrix 13 and its possible cracking.

Although the present invention has been described with reference to a heat exchanger in which flexible enclosing members 16 interconnect alternate pairs of adjacent primary plates 14, it will be appreciated that in fact the flexible members could interconnect every pair of primary plates 14. In such an arrangement, it would of course be necessary to provide an alternative method of directing the hot gas stream 12 between the relevant pairs of primary plates 14. One way of achieving this would be to provide two further tubes similar to those shown at 21 and 22. Such tubes would be provided with appropriately positioned slits to direct the hot gas into the appropriate chambers defined by the primary plates 14.

We claim:

1. A heat exchanger comprising a casing and a matrix, said matrix being enclosed within said casing, said matrix comprising a stack of primary plates; spacer means constituted by sheets of corrugated material, said corrugated material being so disposed that the peaks of the corrugations thereof engage and are attached to said primary plates; and corrugated enclosing members, the planes of the peaks of the corrugations in said enclosing members extending in directions which are generally normal to said primary plates; each of said plates being held in spaced apart relationship from adjacent plates by said spacer means so that alternate flow paths for first and second heat exchange fluids respectively are defined by said plates, the peripheries of at least alternate pairs of adjacent plates being interconnected by said enclosing members so that the flow paths for the first of said heat exchange fluids are not in flow communication with the flow paths for the second of said heat exchange fluids, fluid delivery and exhaust means being respectively provided for each of said first and second fluids to direct said fluids into their respective flow paths within said matrix and exhaust said fluids from those flow paths, said second heat exchange fluid operationally flowing through said casing, said matrix being so arranged that said second heat exchange fluid flows through the appropriate flow paths in said matrix on its passage through said casing.

2. A heat exchanger as claimed in claim 1 wherein said fluid delivery and exhaust means comprises first and second pipes which respectively deliver the first of said heat exchange fluids to and exhaust said first heat exchange fluid from the flow paths in said matrix defined by said alternate pairs of adjacent plates interconnected by said flexible enclosing members.

3. A heat exchanger as claimed in claim 2 wherein each of said first and second pipes passes through each of said flow paths defined by said alternate pairs of adjacent plates interconnected by said flexible enclosing members, said first and second pipes being provided with openings therein which provide flow communication between said pipes and said flow, paths.

4. A heat exchanger as claimed in claim 1 wherein said matrix is so arranged that said first and second heat exchange fluids flow in contra-flow relationship within said matrix.

* * * * *